US009177679B2

(12) United States Patent
Nolen, Jr. et al.

(10) Patent No.: US 9,177,679 B2
(45) Date of Patent: Nov. 3, 2015

(54) ACCELERATOR-BASED METHOD OF PRODUCING ISOTOPES

(75) Inventors: Jerry A. Nolen, Jr., Chicago, IL (US); Itacil C. Gomes, Naperville, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 840 days.

(21) Appl. No.: 13/026,102

(22) Filed: Feb. 11, 2011

(65) Prior Publication Data

US 2011/0194662 A1 Aug. 11, 2011

Related U.S. Application Data

(60) Provisional application No. 61/303,497, filed on Feb. 11, 2010.

(51) Int. Cl.

| | |
|---|---|
| ***G21G 1/06*** | (2006.01) |
| ***G21G 1/08*** | (2006.01) |
| ***G21G 1/00*** | (2006.01) |
| ***G21G 1/10*** | (2006.01) |

(52) U.S. Cl.

CPC .. *G21G 1/08* (2013.01); *G21G 1/00* (2013.01); *G21G 1/10* (2013.01); *G21G 2001/0036* (2013.01)

(58) Field of Classification Search

CPC ..... H05H 3/06; H05H 6/00; G21G 4/02; G21G 2001/0036; G21G 2001/0063; G21G 1/10

USPC ..... 376/192

See application file for complete search history.

(56) References Cited

U.S. PATENT DOCUMENTS

| | | | | | |
|---|---|---|---|---|---|
| 2,161,985 | A | * | 6/1939 | Szilard | 376/156 |
| 2,929,933 | A | * | 3/1960 | Ela, Jr et al. | 376/190 |
| 2,938,844 | A | * | 5/1960 | Graham et al. | 376/358 |
| 3,033,652 | A | * | 5/1962 | Gleason | 376/169 |
| 3,226,298 | A | * | 12/1965 | Gemmill | 376/169 |
| 3,745,067 | A | * | 7/1973 | Arino et al. | 376/169 |
| 4,017,583 | A | | 4/1977 | Motojima et al. | |
| 4,280,053 | A | | 7/1981 | Evans et al. | |
| 4,309,249 | A | * | 1/1982 | Steinberg et al. | 376/192 |
| 4,360,495 | A | * | 11/1982 | Bauer | 376/151 |

(Continued)

OTHER PUBLICATIONS

Russell et al. "Introduction to Spallation Physics and Spallation Target Design" LA-UR-95-817, Submitted to International Conference on Accelerator-Driven Transmutation Technologies and Applications, Jul. 25-29, 1995.*

(Continued)

*Primary Examiner* — Jack W Keith
*Assistant Examiner* — Sharon M Davis
(74) *Attorney, Agent, or Firm* — Cherskov Flaynik & Gurda, LLC

(57) ABSTRACT

The invention provides a method using accelerators to produce radio-isotopes in high quantities. The method comprises: supplying a "core" of low-enrichment fissile material arranged in a spherical array of LEU combined with water moderator. The array is surrounded by substrates which serve as multipliers and moderators as well as neutron shielding substrates. A flux of neutrons enters the low-enrichment fissile material and causes fissions therein for a time sufficient to generate desired quantities of isotopes from the fissile material. The radio-isotopes are extracted from said fissile material by chemical processing or other means.

10 Claims, 3 Drawing Sheets

(56) References Cited

U.S. PATENT DOCUMENTS

| | | | | | |
|---|---|---|---|---|---|
| 4,622,201 | A * | 11/1986 | Robertson et al. | 376/192 |
| 5,160,696 | A * | 11/1992 | Bowman | 376/189 |
| 5,468,355 | A * | 11/1995 | Shefer et al. | 204/157.2 |
| 5,596,611 | A * | 1/1997 | Ball | 376/189 |
| 5,633,900 | A * | 5/1997 | Hassal | 376/189 |
| 5,774,514 | A * | 6/1998 | Rubbia | 376/193 |
| 5,784,423 | A | 7/1998 | Lidsky et al. | |
| 5,910,971 | A * | 6/1999 | Ponomarev-Stepnoy et al. | 376/189 |
| 5,987,087 | A * | 11/1999 | Zhuikov et al. | 376/195 |
| 6,160,862 | A * | 12/2000 | Wiencek et al. | 376/202 |
| 6,845,137 | B2 * | 1/2005 | Ruth et al. | 376/195 |
| 6,895,064 | B2 * | 5/2005 | Ritter | 376/194 |
| 2005/0069076 | A1 * | 3/2005 | Bricault et al. | 376/190 |
| 2006/0023829 | A1 * | 2/2006 | Schenter et al. | 376/190 |
| 2007/0064858 | A1 * | 3/2007 | Nye et al. | 376/157 |
| 2007/0297554 | A1 * | 12/2007 | Lavie et al. | 376/190 |
| 2009/0162278 | A1 * | 6/2009 | Ravn et al. | 424/1.37 |
| 2010/0028234 | A1 * | 2/2010 | Ehst et al. | 423/249 |
| 2010/0215137 | A1 * | 8/2010 | Nagai et al. | 376/158 |
| 2011/0096887 | A1 * | 4/2011 | Piefer | 376/193 |
| 2011/0118491 | A1 * | 5/2011 | Wolterbeek et al. | 556/59 |
| 2011/0129049 | A1 * | 6/2011 | Schenter | 376/158 |
| 2011/0272272 | A1 * | 11/2011 | Pitcher | 204/157.21 |
| 2011/0280356 | A1 * | 11/2011 | Tsang | 376/189 |
| 2011/0317795 | A1 | 12/2011 | Zhuikov et al. | |

OTHER PUBLICATIONS

Gomes, I.C., "Simulation of Keff for Small Neutron Multiplier and Calculation of Performance with a Coupled Accelerator", ANL Final Report, 8 pages, Naperville, Illinois.

Nolen, J.A., "An Advanced Accelerator-Based Concept to Produce Isotopes for Medicine and Physics", Argonne Physics Division presentation to NSAC Panel on Isotopes, Feb. 11, 2009, Rockville, MD.

Vandergrift, G. F., et al., "Overview of 2007 ANL Progress for Conversion of HEU-Based Mo-99 Production as Part of the U.S. Global Threat Reduction-Conversion Program", The RERTR-2007 International Meeting on Reduced Enrichment for Research and Test Reactors, Sep. 23-27, 2007, Prague, Czech Republic.

Karni, Y., et al., "The SMORES Capability for Minimum Critical Mass Determination", ICNC2003 Proc., p. 125.

Jongen, Yves, "A Cyclotron driven neutron multiplier for the production of Mo 99", 37th ECPM, Oct. 29, 2009, Groningen.

National Research Counsil, "Medical Isotope Production Without Highly Enriched Uranium", National Academy of Sciences, ISBN: 0-309-13040-9, 240 pages, (2009), The National Academies Press, Washington, D.C.

* cited by examiner

ACCELERATOR-BASED METHOD OF PRODUCING ISOTOPES

PRIORITY CLAIM

This utility application claims the benefit of U.S. Provisional Patent Application No. 61/303,497 filed on Feb. 11, 2010, the entirety of which is incorporated herein.

CONTRACTUAL ORIGIN OF THE INVENTION

The United States Government has rights in this invention pursuant to Contract No. DE-AC02-06CH-111357 between the United States Government and UChicago Argonne, LLC representing Argonne National Laboratory.

BACKGROUND OF THE INVENTION

1. Field of the Invention

This invention relates to the production of radioactive isotopes and, more particularly, to a method for accelerator-driven system (ADS) isotope production by means of nuclear fission.

2. Background of the Invention

Radioactive nuclear isotopes are used in a variety of applications. One of the most important uses is in medicine wherein the isotopes serve either as tracers for diagnostic purposes or to attack tumor cells in which they are injected or otherwise implanted. Two isotopes that are frequently used are $^{99}$Mo (half life 66 hours) and $^{131}$I (half life 8 days). Given these short lifetimes, it is impractical to stock-pile them. They must be produced continuously and delivered quickly. Also, although the U.S. often imports these isotopes from abroad (Canada, Belgium), a sizable fraction of the radio activity of a shipment decays in transit. Currently most of the $^{99}$Mo used in the U.S. is supplied by the Chalk River reactor in Eastern Canada.

$^{99}$Mo and $^{131}$I are not naturally occurring radionuclides nor are they the products of the radioactive decay of naturally occurring radionuclides. A way they can be produced is from the fission of fissionable isotopes such as $^{235}$U ($^{239}$Pu can also be used). Irradiation or bombardment of fissionable material with neutrons, either in the core or in the reflector region of a nuclear reactor, is one method for inducing fission in specially designed production targets. However, most of the worldwide nuclear reactors used in the production of those isotopes are at, or even past, their design life expectancy. They are often shut down for rather long periods for repairs and maintenance. Many of these reactors are due for major refurbishment or decommissioning.

The $^{99}$Mo production targets used in reactors are mostly made of highly enriched uranium (90+ percent $^{235}$U). This is the same enriched uranium that is used in nuclear weapons; as such, its use poses a serious security threat. First, it is a target for rogue states or groups desiring to acquire nuclear weapons capability. Second, its introduction into an already critical reactor, without a careful analysis and safety review, increases the possibility of a runaway accident.

The introduction of isotope-producing $^{235}$U requires careful analysis and deployment for a safe operation. Moreover, isotope production is parasitical to other reactor uses. Finally, production of isotopes requires continuous operation of a nuclear reactor to meet demand.

The "ADONIS" project was pursued in Belgium as a method of producing $^{99}$Mo with an accelerator [See Y. Jongen, "A cyclotron driven neutron multiplier for the production of 99Mo," at the 37th European Cyclotron Progress Meeting, Groningen, The Netherlands, Oct. 29, 2009].

Other accelerator-based methods of producing $^{99}$Mo are being considered. For example, electron beam accelerators can be used to drive the fission process in depleted uranium ($^{238}$U). But this process requires a very large amount of beam power (~75 MW) to produce 99Mo at the scale required in the U.S.

Another proposed approach is to irradiate a separated isotope $^{100}$Mo with high power electron beams (~5 MW) to produce $^{99}$Mo via the photonuclear reaction $^{100}$Mo(γ,n)$^{99}$Mo. It also requires the expensive separated isotope $^{100}$Mo as the target material to produce $^{99}$Mo as a very small component of the irradiated target of stable $^{100}$Mo. Extracting the essential daughter isotope $^{99m}$Tc from such a low specific activity irradiated target is an undesirable feature of this process.

There is a need in the art for a method and a system to provide continuous and abundant production of Mo and other short-lived isotopes by means of an accelerator-driven system. The method should induce fission in fissile material in a manner that will not use weapons-grade material. The method should neither add to the production of nuclear waste, nor should it pose a danger of reaching criticality. The amount of fissile material used should be the minimum required to produce the required amount of isotope and the isotope produced should have a high specific activity as measured by the amount of isotope produced per gram of fissile material. The method should also be energy efficient as measured by the amount of isotope produced for a given electrical power used by the accelerator.

SUMMARY OF THE INVENTION

An object of this invention is to provide a method and system for producing nuclear isotopes that overcomes several drawbacks of the prior art.

A further object of the present invention is to provide a method of isotope production that does not require the use of a nuclear reactor. A feature of the method is the use of an accelerator beam to induce the production of neutrons in an amount greater than $10^{14}$ n/cm$^2$-sec. An advantage of the invention is that the method can be implemented at a relatively inexpensive stand-alone facility which utilizes a compact reactor core. Another advantage of the invention is that due to the small size of the core, the amount of shielding required is much smaller than that required for conventional research nuclear reactors.

Another object of the present invention is to provide a method of isotope production that does not use highly enriched uranium. A feature of the method is the use of low-enrichment (e.g. approximately <20 percent enriched) uranium (LEU). An advantage of the invention is that it poses very low risks of a run-away chain reaction, or of becoming a target of rogue states or groups seeking weapons grade nuclear material.

Yet another object of the present invention is to provide a method of isotope production and thermal energy that requires primary beam powers no greater than 100 kW. Alternatively, no driver beam is necessary if the core is driven critical, such that it becomes self sustaining. A feature of the invention is the use of neutron-multiplier material enveloping the fissile material. An advantage of the invention is that the method uses a reduced amount of fissile material due to the relative positioning of low enrichment uranium (LEU) target material and interspersed water moderator.

Briefly the present invention provides a method to produce radio-isotopes. The method comprises: supplying a "core" of low-enrichment fissile material arranged in a spherical array of LEU combined with water moderator. The array is surrounded by a beryllium-containing substrate and carbon-containing substrate, both substrates which serve as multipliers and moderators as well as neutron shielding substrates.

Also provided is a system to produce radio-isotopes comprising a core of low-enrichment fissile material, said core being surrounded by neutron-moderating materials; high-atomic-number ("high Z") material juxtaposed to the core; a charged particle beam bombarding the high-Z material so as to produce a flux of neutrons in a given direction; with said neutrons contacting the low-enrichment fissile material and causing fissions therein for a time sufficient to generate desired quantities of isotopes from the fissile material; and a means to extract said radio-isotopes from said fissile material.

Another embodiment of the invention comprises the above elements, but without the need for high Z-target material and without the need for the driver accelerator. This embodiment is utilized when the core is driven critical. Preferably, this embodiment would include a criticality control system comprised of control rods and/or the addition of a burnable poison mixture to the moderator.

In operation of the invention, a high-Z (high atomic number) target material located next to the core (e.g. either external from, or internal to the core) is irradiated with a charged particle beam so as to produce a flux of neutrons. This flux enters the low-enrichment fissile material and causes fissions therein for a time sufficient to generate desired quantities of isotopes from the fissile material. The radio-isotopes are extracted from said fissile material by chemical processing or other means. In a critical version, the reactor is set at an specified power level and maintained at this power level moving the control rods or changing the amount of burnable poison in the moderator.

BRIEF DESCRIPTION OF THE DRAWING

The foregoing and other objects, aspects, and advantages of this invention will be better understood from the following detailed description of the preferred embodiments of the invention with reference to the drawing, in which.

DETAILED DESCRIPTION OF THE INVENTION

Figure 1:
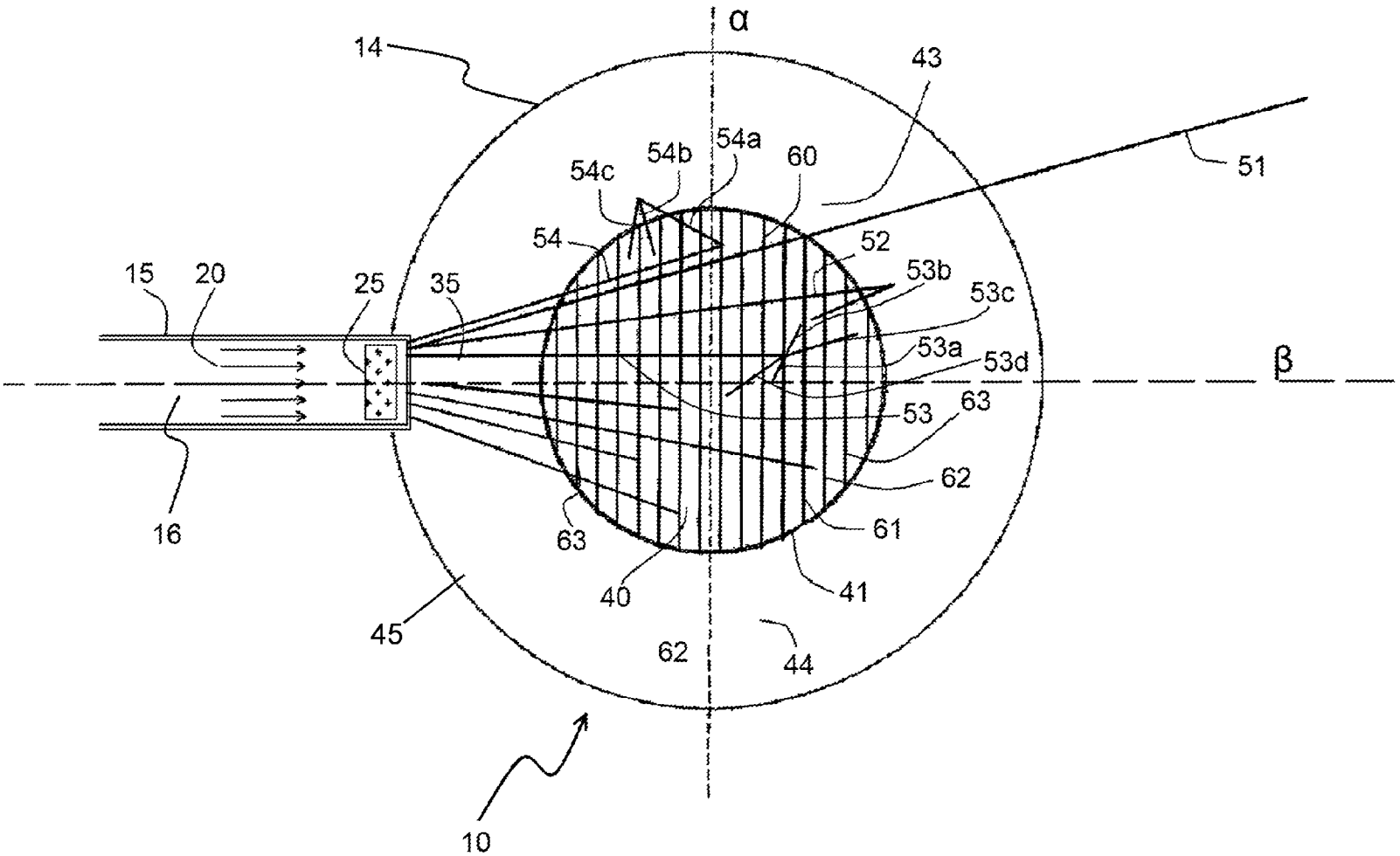
FIG. 1 is an overall schematic view of an exemplary embodiment of a system for the production of radioactive isotopes, in accordance with features of the present invention.

The foregoing summary, as well as the following detailed description of certain embodiments of the present invention, will be better understood when read in conjunction with the appended drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The present invention introduces a method and a device to produce radio-isotopes, including some isotopes that are very important for medical diagnostics and treatment. The low mass required to achieve criticality of the fissionable material plus moderator configuration allows the use of this invention for other applications as such space missions and homeland security.

The invention provides a small footprint for isotope production. This small size requires low residual activation and small amounts of shielding (compared with nuclear reactors). However, the system is easily scalable, thereby allowing its use for much higher or lower production rates.

An embodiment of the invention utilizes a proton beam from a 200 MeV accelerator (either a LINAC or a cyclotron) to strike a target of depleted uranium. An accelerator accelerates charged particles to an energy between 10 MeV and 70 MeV. The neutrons subsequently generated induce fissions in low-enrichment (19.95%) $^{235}U$ contained in an enclosure, such as a near spherical enclosure, which contains a combination of LEU and water. The water serves as both a moderator and a coolant. As noted elsewhere in this specification, other moderators are also suitable, either alone or in combination with the water.

The invented system has several salient aspects, including that substantially all of the fissile material is used for the production of radio-isotopes. Also, the near spherical configuration of the enclosure core provides a means for core neutron multiplication (i.e. amplification of the number of neutrons). As a result, the number of fissions generated per proton ranges from between 10 and 15. A 200-MeV, 100-kW proton beam impinging on depleted uranium as a neutron producing target, yields 13.3 fissions/proton, for example.

The enclosure core substantially encapsulates an inner core so as to physically isolate the inner core from the surroundings of the enclosure core. A myriad of diameters of the inner core are suitable. An exemplary inner core has a diameter of approximately 20-centimeter (cm) and is a near spherical construct comprised of an arrangement of thin LEU foils and normal water. This construct is surrounded by a combination of materials acting as a neutron reflector. This combination of materials further provides additional moderation and shielding.

Isotopes are produced in the LEU foils of the core by neutron-induced fission, mainly of the 19.9% $^{235}U$ component. In an embodiment of the invention, the LEU foils are coated with a thin layer of a material such as aluminum or nickel. These thin layers of material provide a means for retaining fission products in the foils so they do not contaminate the water. The uranium-containing foils differ from the HEU-containing substrates used in typical reactor systems. Generally, the LEU foils range in thickness from about 50 to 150 μm.

After irradiation, the LEU foils of the core are substantially dissolved using conventional isotope extraction protocols to extract the isotopes. An exemplary protocol is "Medical Isotope Production Without Highly Enriched Uranium" The National Academies Press, National Academy of Sciences, Washington, D.C., 2009, the entirety of which is incorporated herein by reference. The only radioactive waste stream produced by the system comes from this irradiated LEU foil material. Other parts of the system will be activated by the operation of the system, but they do not need to be replaced frequently.

In an embodiment of the invented system, the primary neutron producing target is positioned just outside the enclosure core and is cooled by flowing water. This embodiment eliminates any interference with the core's interior cooling system, so as to prevent fluid communication between the interior of the core and the exterior of the core.

An exemplary embodiment of the invented system, designated as numeral 10, is illustrated in FIG. 1. The system 10 incorporates the generation of a neutron beam. A LINAC, or other type of particle accelerator is utilized to bombard a target to produce the neutrons. In one embodiment, the LINAC (or possibly a cyclotron) 15 is utilized to produce a 70 to 2000 MeV, but preferably 200-250 MeV, approximate 100-kW proton beam 20. Aside from protons, other beam particles such as deuterons, helium nuclei or lithium nuclei could be used. Similarly, the neutron multiplier target can be used with lower energy accelerators. In the case of the embodiment of driving the core critical by increasing the amount of fissionable material, there is no need for an external driver inasmuch as the configuration of the core sustains critical chain reactions. Instead, that criticality is controlled by conventional reactor control systems, but on a much smaller scale, including the use of moderators and shields utilized in those systems.

In an embodiment of the invention, a target 25, is positioned external from a fissile core enclosure 14, The target 25 serves as a neutron source and is positioned downstream but not within the accelerating enclosure (not shown), Nevertheless, the target is located within the accelerator vacuum chamber 16 so as to be contacted by the proton beam. As such, the target is positioned along the longitudinal axis β of the device and between the source of the proton beams 20 and a core 40 of fissile material. Additionally, the target 25 is positioned and in close spatial relation to the central array of LEU foils. If a 200 MeV charged particle beam is utilized, the target preferably comprises a high-Z material (atomic number higher than 70) such as depleted uranium, thorium, bismuth, lead, tantalum, or tungsten (or a combination thereof).

High-energy beam particles are preferable for a heavy-element target to overcome the Coulomb (electrostatic) repulsion between beam particles and target particles. The inventors calculate that a 200 MeV proton beam would produce about 2 to 3 primary neutrons/proton using depleted uranium as the target. For a low energy beam, the target would be a "light element" such as lithium, beryllium, or carbon. The target is water-cooled in both the high and the low energy cases. Alternatively, for the low energy case, liquid lithium and/or rotating wheels of beryllium or carbon can be utilized.

Upon irradiation of the target 25, a neutron beam 35 exits the accelerator enclosure and is directed predominantly in the same direction as the path taken of beam particles before the beam particles contact the target 25. The neutron beam 35 subsequently strikes the "core" 40 comprising low enrichment fissile material (LEU) such as low-enrichment uranium (i.e., below about 20 percent (e.g., 19.99% $^{235}$U). As discussed supra, the approximately 20 percent enrichment amount is preferably is the suitable upper limit of enrichment to avoid nuclear weapons proliferation threat. If such a threat is a non-issue (for example if the invention is practiced in a secure facility, or in spacecraft) enrichment values of up to 95 percent are suitable.

Figure 2:
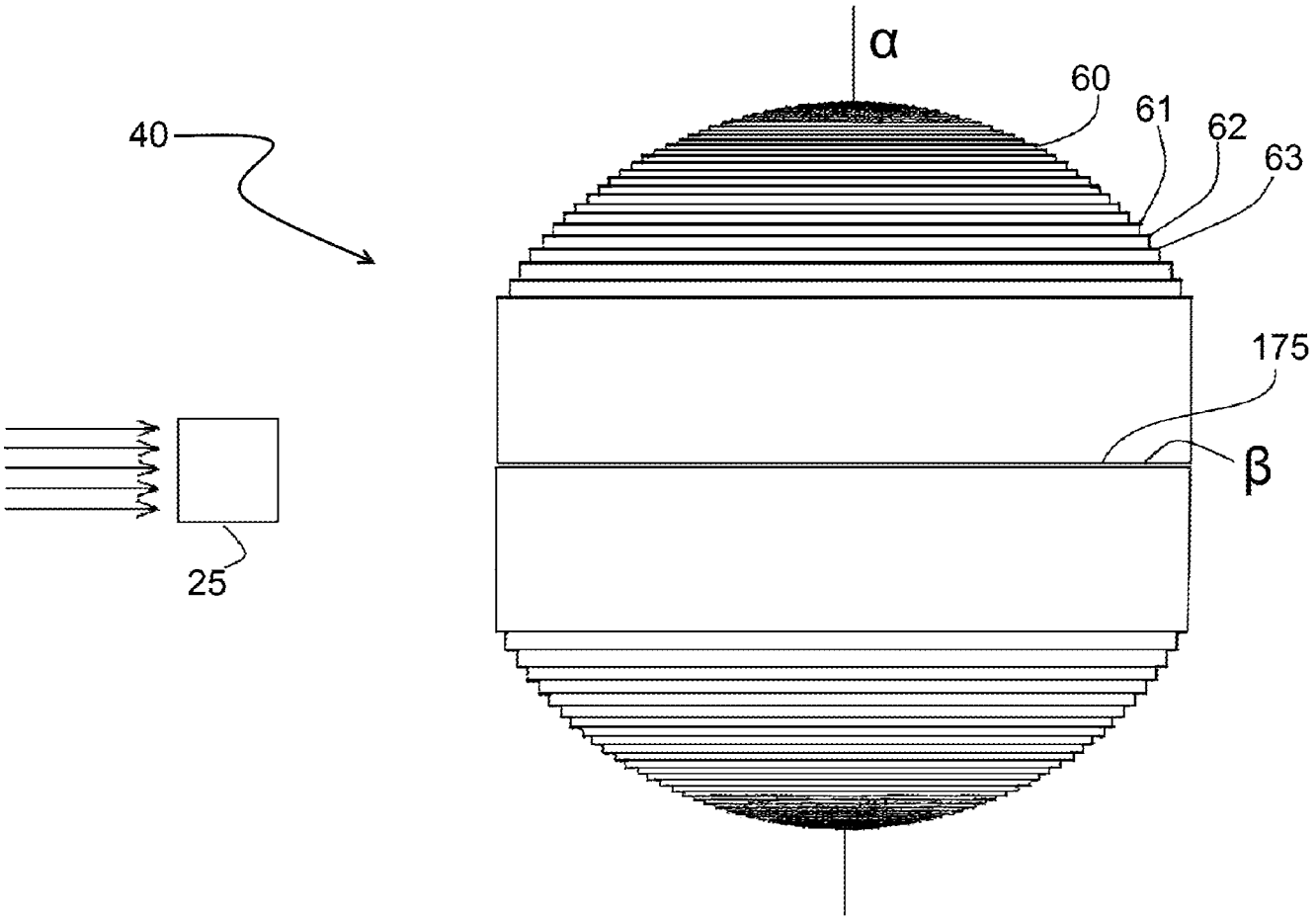
FIG. 2 is a schematic view of a preferred embodiment of a fissile target or "core" for a system for the production of artificial isotopes, in accordance with features of the present invention.

A perspective view of the reactor core 40 is shown in FIG. 2. The core is positioned downstream from the target 25 but outside the vacuum enclosure 15 of the linac. In one embodiment, the core comprises thin (25-100 μm) metal clad $^{235}$U cylinders 60 coaxial to the transverse axis α of the device. The axis α is substantially perpendicular to the longitudinal axis β of the device. This configuration substantially maximizes interception of many of the neutrons emanating from the primary target 25.

The compact reactor core can be driven critical by increasing the amount the fissionable material, making it an attractive option for space missions and homeland security applications.

FIG. 2 shows a perspective view of the inner part of the core 40. The axially symmetric arrangement maximizes the number of fissions per beam particle while simultaneously allowing cooling of substantially all surfaces of the fissile material. The uranium coaxial cylinders 60 are substantially enclosed or otherwise disposed in a spherically configured array to form the core 40. The cylinders are held together by spacers that can each be clamped or bolted to adjacent or flanking cylinders. Radially projecting plates interconnecting the cylinders is another feature for those core constructs requiring additional rigidity and thermal conductance between the cylinders. The coolant flow will not be required to be at a high flow rate because the small thickness of the uranium shells associated with the large surface area for heat transfer result in a relatively small heat flux leaving the plate. As such, the fuel foils are not going to be under high stress due to coolant flow. Also, in the case of using LiH moderator, the core can operate at much higher temperature and be cooled by high temperature gas flowing in channels attached to the fuel plates or through the LiH moderator.

FIG. 2 depicts a first cylinder 61 nested within and coaxial to a second cylinder 62, which in turn is nested in and coaxial to a third cylinder 63. This nesting defines a plurality of annular spaces between the cylinders. All longitudinal axis of the cylinders are coaxial to the transverse axis α. The uranium cylinders are disposed in a nearly spherically symmetric array or construct with the annular space between each of the cylinders providing a means for circulation of moderating/cooling fluid, such as water. The cylinders combined with the fluid define the core 40 of the system.

The sphere has an equatorial plane β that contains the target 25 and the charged particle beam 15.

Figure 3:
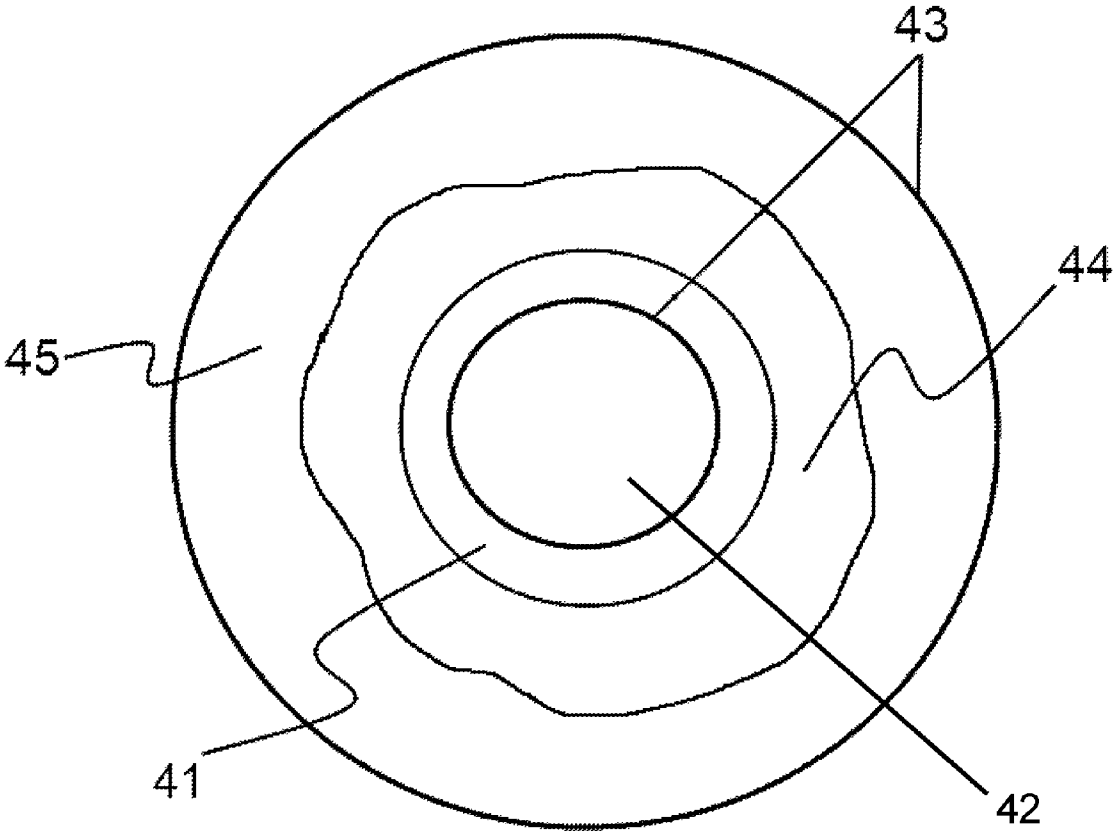
FIG. 3 is a schematic view of primary core containment layers, in accordance with features of the present invention.

Water circulates inside the core serving as both a coolant and a moderator for the neutrons, in the space between the uranium cylinders. As depicted in FIG. 3, the uranium array 42 is surrounded by a shell 43 comprising a first layer 41 of LEU, that layer between 100 and 200 μm thick. Substantially overlaying, so as to encapsulate this inner layer is a second layer 44 comprising beryllium (this second layer about 10-30 cm thick). The beryllium layer is in turn surrounded by a layer 45 of carbon. (Other neutron moderators are suitable.) The thickness and definition of the outer layers, except the uranium and beryllium spherical shell are to be defined by shielding/moderator optimization and will depend on the reactor power level. If personnel are in proximity, shielding has to provide protection to those personnel.

The beryllium shell acts as a neutron multiplier through the reaction $^{9}Be+n \rightarrow {}^{8}Be+2n$ and also as a neutron reflector so that neutrons with an outwardly-directed radial velocity are redirected back towards the uranium core after multiple scattering collisions. The beryllium also moderates the neutrons because it is a low-Z material and the neutrons lose a significant amount of their energy at each collision event.

FIG. 1 illustrates some of the primary events that take place in the core 40. A ray 51 represents a target-produced neutron that has no interactions in the core 40. A ray 52 represents a target-produced neutron that is reflected by the beryllium layer 44. The U nuclei fission when impacted by neutrons such as those defined by a ray 53 from the beam 35, these fissions considered "primary fissions". Each fission produces a "light fragment" (atomic mass "A" of from about 85 to 105), a "heavy fragment" ("A" typically from about 125 to 150) and 2 or 3 neutrons ("secondary neutrons"), designated as element numbers 53*c*, 53*d*. The fission fragments remain in the $^{235}U$ foils to serve as a means for initiating a cascade of beta decays, two beta particles being shown as 53*a* and 53*b*. The secondary neutrons such as 53*c* may provide a means for causing other U nuclei to fission ("secondary fissions").

The ratio (secondary fissions)/(primary fissions) is denoted as keff (and also called "criticality") and, in the preferred embodiment, it has a value of approximately 0.95 (The net number of neutrons/proton ("Mult") is approximately 20 at the beginning of a near week-long run. Keff of about 0.95 ensures safe operation. In a critical core embodiment of the invention, the fresh core has an excess of criticality compatible with the expected lifetime of the core at a given power level. At each fission event one atom of the fissionable material is lost, such that fresh fuel has to have enough extra fissionable atoms to compensate the losses during the lifetime of the core plus the negative reactivity represented by the neutron absorbing fission products.

FIG. 1 also illustrates a neutron 54 striking a cylinder 60 where a secondary neutron 54*a* is produced, the newly produced neutron 54*a* striking the beryllium layer 44 causing a reaction whereby neutrons 54*b* and 54*c* are produced (i.e. "neutron multiplication").

In an exemplary embodiment of the invention, the core 40 is covered with a LEU/Beryllium/Carbon shell 43 as shown in FIGS. 1 and 3. The target 25 is located proximally to the LEU/Be/C shell at a location defined by the equatorial plane P of the core 40. As noted supra, the target 25 is positioned downstream and preferably at the distal end of a charged particle beam line and located just upstream of the central core of LEWU foils 40. Other neutron-moderators also can be used to envelop the core.

Operation Detail

Typically the core is irradiated for between about 50 and 300 hours, depending on the isotope being generated, and therefore its half life. In an embodiment of the invented production method, the core is irradiated for about two half lives of the isotope of interest. For example, the core is irradiated for between about 100 and 150 hours, preferably about 135 hours, and most preferably about 132 hours (5.5 days) when optimized for the production of $^{90}Mo$ (two half-lives) after which time about 3.3 percent of the uranium is spent, lowering the keff by a small amount.

The core is dismantled and the desired isotopes are recovered by conventional harvesting methods, such as chemical extraction. The remaining uranium is stored as radioactive waste, utilizing the same storage protocols as is used after the production of such isotopes produced by nuclear reactors.

An embodiment of the invention yields about 140 Ci/g of $^{235}U$ with 300 g of $^{235}U$ in the core, producing in 5.5 days somewhat more than the present U.S. need as normalized to 6000 6-day Ci of $Mo^{99}$.

Thermal Management Detail

The fission of uranium in the core generates heat that is removed by a suitable heat exchange medium, such as water circulating around and physically contacting the uranium cylinders.

In a system driven by a 200-MeV, 100-kW proton beam, the heat flux at the surface of the LEU foils is 30 to 50 W/cm$^2$ and the total heat generated in the system is ca 1.3 MW, 96.5% of which is in the fission fragments. In a 100 μm plate configuration, the fission sites are within 50 μm of the cooling water, allowing good heat transfer (thickness of the uranium foils, including fission barrier metallic cladding is about 100 μm). Note that these values are illustrative and can be fine-tuned as necessary for effective cooling of the core.

In the exemplary embodiment of the system, if the temperature increase of the water between the cylinders is restricted to 40° K or less, then preferably the entire volume of water is replaced in about 0.5 s. For a 20-cm cooling path, the required water velocity is about 0.4 m/s.

Heat transfer from the core is enhanced by the fact that the core components 60 present a large overall integrated area for heat-transfer—i.e. simple cylinder, honey-comb type, or corrugated cylindrical foils with a very short, 50 mm or less, distance between heat-generating site and the coolant.

The neutron flux produced at the core of the invention extends to the reflector region allowing the use of the high neutron flux for generating other radioisotopes of interest. There are several radioisotopes of interest that can be produced by thermal neutron flux, as an example by the reactions, $^{108}Cd(n,\gamma)^{109}Cd$; $^{107}Ag(n,\gamma)^{108}Ag$; $^{88}Sr(n,\gamma)^{89}Sr$; $^{168}Yb(n,\gamma)^{169}Yb$ and for fast neutron flux, as an example, $^{58}Ni(n,p)^{58}Co$; $^{117}Sn(n,n)^{117m}Sn$ among others.

The invented subcritical system, as designed, has the intrinsic advantage, when compared with a nuclear reactor, of allowing an easy access to the neutron irradiation samples, given the relatively small size of the device. Irradiation locations can be made available by drilling holes in the reflector region in such a way that samples can be irradiated near the core where an irradiation neutron flux greater than 1) neutrons/cm$^2$-sec is available, for example when a 200-MeV, 100-kW proton beam driver is applied to the system. Also, in an embodiment where the core is replaced after each cycle, the beryllium multiplier layer is easily accessible and can also be replaced or modified periodically to allow special irradiation positions or irradiation configurations.

It is to be understood that the above description is intended to be illustrative, and not restrictive. For example, the above-described embodiments (and/or aspects thereof) may be used in combination with each other. In addition many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The invention claimed is:

1. A subcritical method to produce Mo-99 comprising:

a) supplying a proton beam having an energy of up to 400 MeV;

b) directing the proton beam at a downstream core of low-enriched uranium, said core comprised of:

a plurality of coated cylindrical foils, said coated cylindrical foils arranged in an array of coaxial cylinders with said cylinders having a common axis orthogonal to the beam direction and with said cylinders decreasing in diameter and increasing in height from the outermost concentric cylinder to the innermost concentric cylinder such that the plurality of coated cylindrical foils forms a substantially spheroidal shape and wherein said core is immersed in water and surrounded by a first shell of low-enriched uranium, a second shell of beryllium, and a third shell of carbon;

c) placing a high-atomic-number ("high-Z") material downstream of the proton beam and upstream of the core;

d) exposing the high-Z material to the proton beam so as to produce a flux of neutrons in the direction of the downstream core, and producing on average greater than 10 fissions in the core for each proton of the proton beam;

e) causing the neutrons to contact the low-enriched uranium and causing fissions therein for a time sufficient to generate desired quantities of Mo-99 from the low-enriched uranium; and f) extracting said Mo-99 from said core.

2. The method as recited in claim 1 wherein the charged particle beam is generated from a linear accelerator.

3. The method as recited in claim 2 wherein said accelerator accelerates charged particles to an energy between 10 MeV and 70 MeV.

4. The method as recited in claim 1 wherein the particle beam has an energy between about 70 MeV and 400 MeV.

5. The method as recited in claim 1 wherein said target of high-Z material is an element selected from the group consisting of uranium, tungsten, bismuth, tantalum, and lead.

6. The method as recited in claim 1 wherein substantially all of the fissile material is exposed to the neutron flux such that it can be used for the production of radio-isotopes.

7. The method as recited in claim 1 wherein a 200-MeV, 100 kW proton beam impinging on the high-Z material outside the core results in a yield of 13.3 fissions per proton in the core array of foils of fissile material.

8. The method as recited in claim 1, wherein the plurality of cylindrical foils is surrounded by a first shell of low enriched uranium, wherein the first shell has a thickness of between 100 and 200 μm, a second shell of beryllium, wherein second shell has a thickness between 10 and 30 cm.

9. The method as recited in claim 8, wherein the second shell is further surrounded by a third shell of a neutron-moderating material.

10. The method as recited in claim 9, wherein the neutron-moderating material is a carbon structure.

* * * * *